US005387134A

United States Patent [19]

Bryce et al.

[11] Patent Number: 5,387,134

[45] Date of Patent: Feb. 7, 1995

[54] ELECTRICAL CONNECTOR SYSTEM

[75] Inventors: Brian Bryce, Limerick; Patrick G. Casey, Kerry; Thomas W. Cruise, Limerick; Paul M. O'Brien, Co. Clare; Matthew Wilhite, Dooravoyle Limerick, all of Ireland

[73] Assignee: Molex Incorporated, Lisle, Ill.

[21] Appl. No.: 90,394

[22] Filed: Jul. 9, 1993

[30] Foreign Application Priority Data

Oct. 9, 1992 [IE] Ireland ..... 2722/92

[51] Int. Cl.[6] ..... H01R 23/24

[52] U.S. Cl. ..... 439/660; 439/629

[58] Field of Search ..... 439/59, 372, 629, 660

[56] References Cited

U.S. PATENT DOCUMENTS 3,757,277 9/1973 Yamanoue et al. ..... 439/660
4,715,820 12/1987 Andrews et al. ..... 439/59
4,734,045 3/1988 Hawkins ..... 439/79
5,052,943 10/1991 Davis ..... 439/357

*Primary Examiner*—Eugene F. Desmond
*Attorney, Agent, or Firm*—Stephen Z. Weiss

[57] ABSTRACT

An electrical connector system includes first and second electrical connectors mateable in a given general direction (A). Each connector includes a housing having a mating end and at least a pair of terminals mounted on the housing. The pair of terminals of each connector have contact portions engageable with the contact portions of the pair of terminals of the other connector. The contact portions of the terminals of at least one of the connectors are at angles to the mating direction to define a generally V-shaped engaging configuration. The contact portions of the terminals of at least one of the connectors are resilient. Therefore, wiping engagement between the respective terminals is effected during mating of the connectors, and the resilient contact portions are effective to store energy upon mating of the connectors, which energy is effective to assist in unmating of the connectors.

5 Claims, 4 Drawing Sheets

ELECTRICAL CONNECTOR SYSTEM

FIELD OF THE INVENTION

This invention generally relates to the art of electrical connectors and, particularly, to an electrical connector system wherein a pair of electrical connectors are mateable in a given general direction and wherein some latitude is allowed for angular mating action of the connectors, with the connectors including spring loaded terminals which provide a wiping action and which assist in disengaging the connectors.

BACKGROUND OF THE INVENTION

Mateable electrical connectors are used in a wide variety of applications in countless electrical or electronic environments. Usually, electrical connectors include dielectric housings mounting a plurality of electrical terminals or contacts. The size, shape, orientation and other parameters of the terminals often dictate the characteristics of the connectors. In some applications, it might be desirable to provide terminals which effect low insertion and withdrawal forces on the connectors during mating and unmating thereof. In other applications it might be desirable to provide a wiping action between the terminals to remove or prevent the buildup of contaminants thereon and to provide a better contact engagement. In still further applications, it might be desirable for the connectors to have some latitude or flexibility in the angular orientation of the connectors during mating and unmating thereof. In other words, some electrical connectors must be mated in a precise linear mating direction, and any variance from that mating action might cause damage to the terminals or other components of the connectors. It can be imagined that providing all of the desirable characteristics in a single electrical connector system can be difficult to design.

For instance, in the field of mobile or battery powered hand-held telephone systems, a mobile phone handset is inserted into and out of a cradle in a base unit. In essence, the handset comprises a terminal device, and the base unit is provided for recharging, data retrieval and other purposes. Along with recharging the batteries of the handset, the base unit may be coupled to other data handling apparatus so that the collected data within the handset can be electrically read by other devices. Heretofore, there have been as many as three separate connectors in a single mobile phone handset to couple the handset to respective connectors in its cradle in the base unit, such as one connector for data, one for power and one for the antenna. In order to reduce costs, it is desirable to incorporate all three of these connector functions into a single electrical connector.

Although the invention herein is applicable to a variety of connector applications in various environments, it can be understood that in mobile telephone applications, a user will not always insert and remove the handset in its cradle in the base unit by a precise linear action. In fact, most often, the handset will be abruptly positioned into its cradle at an angle. In such applications, some latitude must be allowed, affording angular mating. Low insertion and withdrawal forces on the mating electrical connectors of the handset and the base unit also is desirable. In addition, because of the open environment of most mobile telephone units, a wiping action between the terminals of the mating connectors is desirable to remove or prevent the buildup of contaminants on the contact portions of the terminals.

Heretofore, the terminals in the signal interface or data portion of the connectors of mobile telephone units have been either of the pin and socket type, a blade and socket type, or a flat surface engageable with a flexible contact arm. Mating pin and socket terminals, as well as mating blade and socket terminals, usually result in insertion and withdrawal forces which are greater than desired. In addition, pin and socket or blade and socket terminals do not provide the angular flexibility or latitude which would be desirable to permit a telephone handset to seat into its cradle in the base unit. Consequently, flat surface contacts often have been used for mating with or engaging flexible contact arms of terminals to provide a low insertion force and to allow for angular flexibility. However, such flat surface contacts do not provide a wiping action between the terminals, and good electrical connection often deteriorates with the buildup of contaminants on the contact portions of the terminals.

This invention is directed to solving the above problems in an electrical connector system which has low insertion and withdrawal forces, which provides angular flexibility or latitude in mating a pair of connectors, and the terminals of the connectors are provided with a significant wiping action.

SUMMARY OF THE INVENTION

An object, therefore, of the invention is to provide a new and improved electrical connector system of the character described above.

In the exemplary embodiment of the invention, the connector system includes first and second electrical connectors mateable in a given general direction. Each connector includes a dielectric housing having a mating end and at least a pair of terminals mounted on the housing. The pair of terminals of each connector have contact portions engageable with the contact portions of the pair of terminals of the other connector. The invention contemplates that the contact portions of the terminals of one of the connectors are at angles to said mating direction to define a generally V-shaped engaging configuration. The contact portions of the terminals of one of the connectors are resilient. A wiping action is effected between the respective terminals during mating of the connectors, and the resilient contact portions are effective to store energy upon mating of the connectors which energy is effective to assist in unmating of the connectors.

More particularly, in the preferred embodiment of the invention, the spring contact portions of the terminals of the first connector are configured to diverge at angles to the mating direction toward the mating end of the first connector in a generally V-configuration. The spring contact portions of the terminals of the second connector are configured to converge at angles to the mating direction toward the mating end of the second connector in a generally V-configuration. The spring contact portions of the first connector diverge at angles to the mating direction which are less than the angles at which the spring contact portions of the second connector converge relative to the mating direction. Therefore, the spring contact portions of the respective connectors have a wiping engagement during mating of the connectors, and the differently angled spring contact portions are effective to store energy upon mating of the connectors and assist in unmating of the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
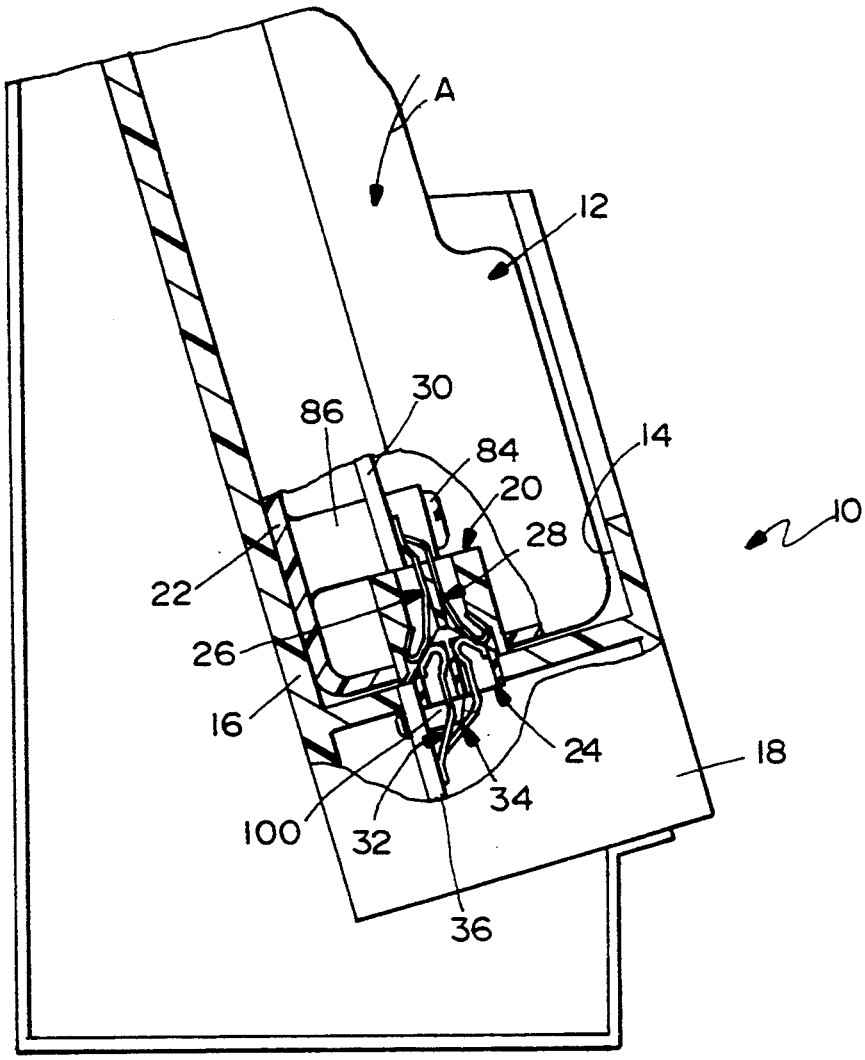
FIG. 1 is a fragmented vertical section through an area of a mobile telephone system where the telephone handset mates within a cradle of a base unit, and incorporating the electrical connector system of the invention.

Referring to the drawings in greater detail, and first to FIG. 1, the electrical connector system of the invention is incorporated in a mobile telephone system, generally designated 10, which includes a portable telephone handset, generally designated 12. The handset is insertable into and removable from a cradle or socket 14 defined in a housing 16 of a base unit, generally designated 18, of the mobile telephone system. The handset is inserted into and removed from the cradle generally in the direction of arrow "A". It can be understood that this direction is not precisely linear and can vary from use to use and depending on the actions of the user.

Although the electrical connector system of the invention has a variety of applications, the system is incorporated in a female connector, generally designated 20, mounted within a casing 22 of handset 12, the female connector being mateable with a male connector, generally designated 24, mounted in housing 16 of base unit 18. In addition, although the precise electronics of the mobile telephone system do not form part of the invention, female connector 22 includes terminals 26 and 28 coupled to a printed circuit board 30 within casing 22 of the handset; and male connector 24 includes terminals 32 and 34 coupled to a printed circuit board 36 within housing 16 of base unit 18. As will be seen in greater detail hereinafter, male and female connectors 24 and 20, respectively, are elongated and mount transverse pairs of terminals 26 and 28 in female connector 20 and terminals 32 and 34 in male connector 24. In the environment of mobile telephone system 10, the terminals may be signal and or data terminals.

Figure 2:
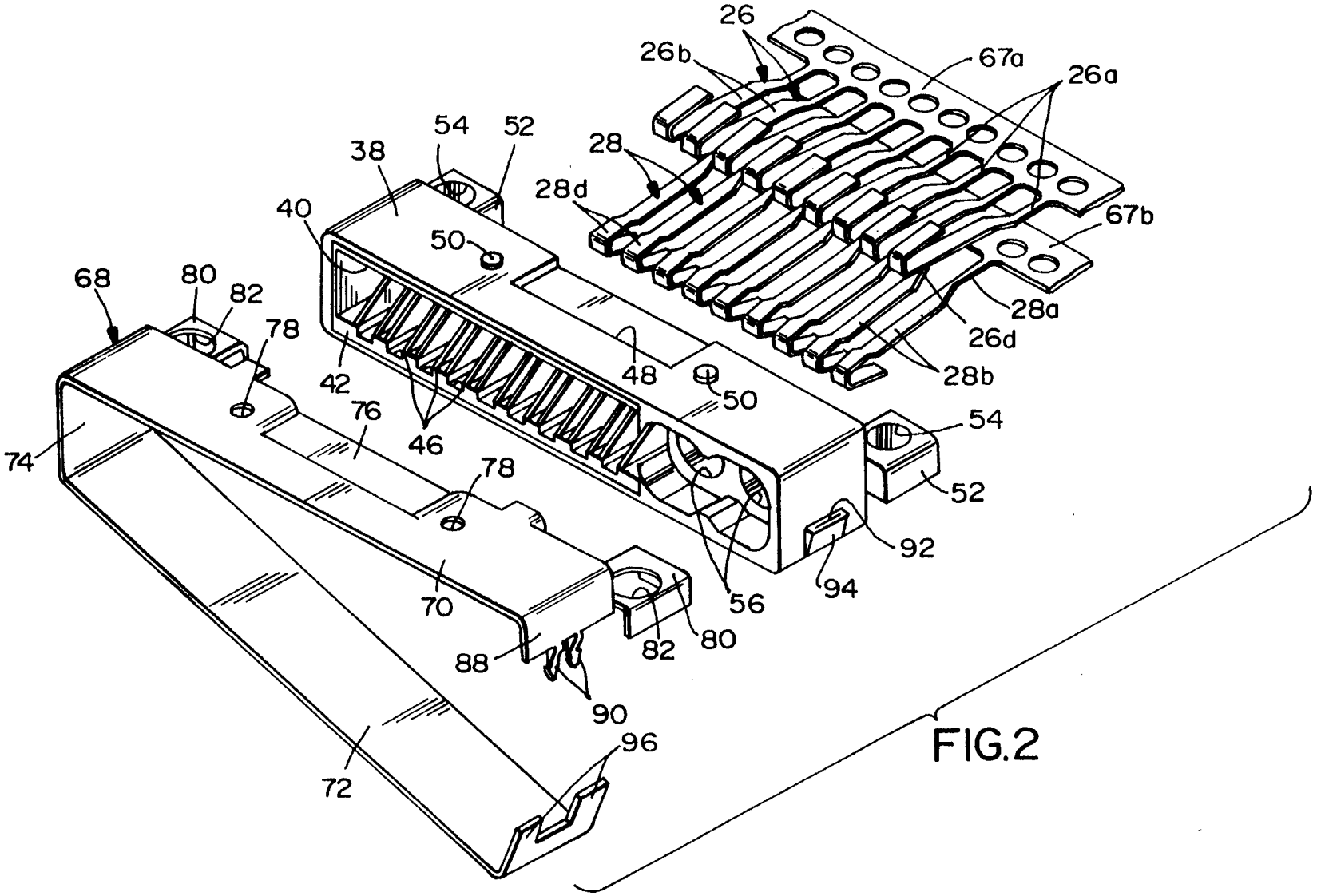
FIG. 2 is an exploded perspective view of the components of the female connector in the telephone handset.
Figure 3:
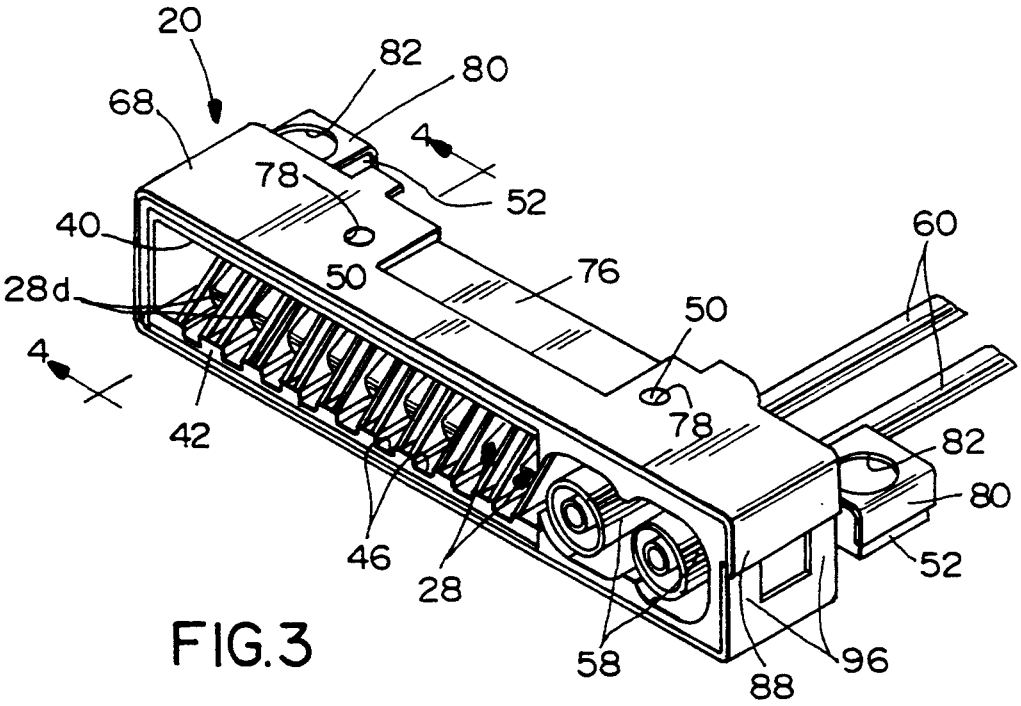
FIG. 3 is a perspective view of the female connector in assembled condition.
Figure 4:
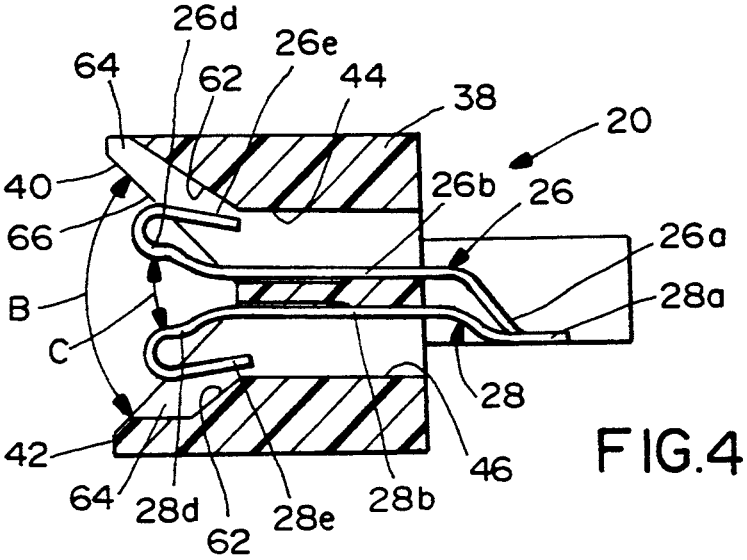
FIG. 4 is a vertical section, on an enlarged scale, taken generally along line 4—4 of FIG. 3.

Referring to FIGS. 2–4 in conjunction with FIG. 1, female connector 20 includes a dielectric housing 38 unitarily molded of plastic material or the like. It can be seen that the housing is elongated and defines a longitudinal opening or slot 40 in a mating end 42 of the housing for receiving the mating end of male connector 24, as will be seen hereinafter. The housing defines a plurality of cavities 44 and 46 for mounting terminals 26 and 28, respectively. Housing 38 further includes a recessed area 48 and a pair of bosses 50 on the top thereof. A pair of mounting blocks 52 project rearwardly from the housing at opposite ends thereof, and mounting holes 54 are provided in the mounting blocks. Lastly, the housing has a pair of sockets 56 (FIG. 2) at one end thereof for receiving a pair of coaxial connectors 58 (FIG. 3) which are terminated to a pair of coaxial cables 60.

Terminals 26 and 28 have solder tails **26*a* and 28*a* at rear ends of spring arm portions 26*b* and 28*b*, respectively, for soldering to solder traces on printed circuit board 30 (FIG. 1). As seen best in FIG. 4, the spring arm portions extend forwardly in cavities 44 and 46. Spring contact portions 26*d* and 28*d* are formed on the other or outer ends of terminals 26 and 28, respectively, and project outwardly of or are exposed at the mating end of female connector 20. The spring contact portions can be seen to be formed by generally U-shaped ends of the terminals bent outwardly and back along spring arm portions 26*b* and 28*b* of the terminals. The U-shaped distal ends 26*e* and 28*e* of terminals 26 and 28, respectively, are positioned for engagement with angled interior walls 62 of housing 38 when the female connector is mated with male connector 24, as described hereinafter. To that end, it further can be seen in FIG. 4 that partitions 64 of housing 38 which define cavities 44 and 46 are shaped at the mating end of the connector to define a V-shaped mouth 66** having an included angle as represented by double-headed arrow "B".

Terminals 26 and 28 are stamped and formed from sheet metal material and are shown in FIG. 2 still connected to carrier strips **67*a* and 67*b*, respectively, which are used during the manufacture of the terminals. The carrier strips are used for "gang" mounting or assembly of the terminals into cavities 44 and 46 of female connector housing 38**.

Lastly, in regard to terminals 26 and 28 of female connector 20, as shown best in FIG. 4, spring contact portions **26*d* and 28*d*** of the terminals are configured so as to define a generally V-configured contacting area as indicated by double-headed arrow "C".

As seen best in FIGS. 2 and 3, female connector 20 is a shielded connector and includes a shield, generally designated 68. The shield is elongated for snugly embracing housing 38 and has an upper wall 70, a lower wall 72, and an end wall 74 integrally joining the upper and lower walls. The upper wall is provided with a depressed area 76 for seating in recessed area 48 of housing 38, along with a pair of holes 78 for receiving bosses 50 of the housing. The upper wall also includes a pair of rearwardly projecting flanges 80 having mounting holes 82 for alignment with mounting holes 54 in mounting blocks 52 of the housing, whereby appropriate fastening means 84 (FIG. 1) can be inserted through the aligned mounting holes for securement to a mounting boss 86 (FIG. 1) integrally molded with casing 22 on the inside of handset 12. Again as seen best in FIG. 2, top wall 70 of shield 60 has a depending end flange 88 with latch hooks 90 projecting therefrom. The latch hooks are snap fit into a slot 92 in the upper edge of a protruding boss 94 at one end of housing 38, with flange 88 overlying flange portions 96 projecting upwardly from bottom wall 72 of the shield, as best seen in Figure 3, when the shield embraces the housing.

Figure 7:
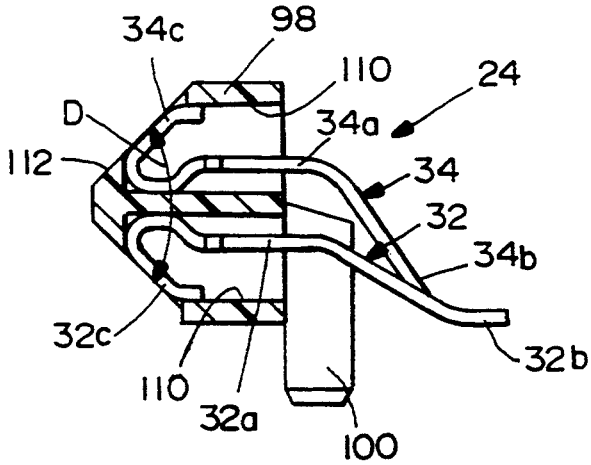
FIG. 7 is a vertical section, on an enlarged scale, taken generally along line 7—7 of FIG. 6.
Figure 5:
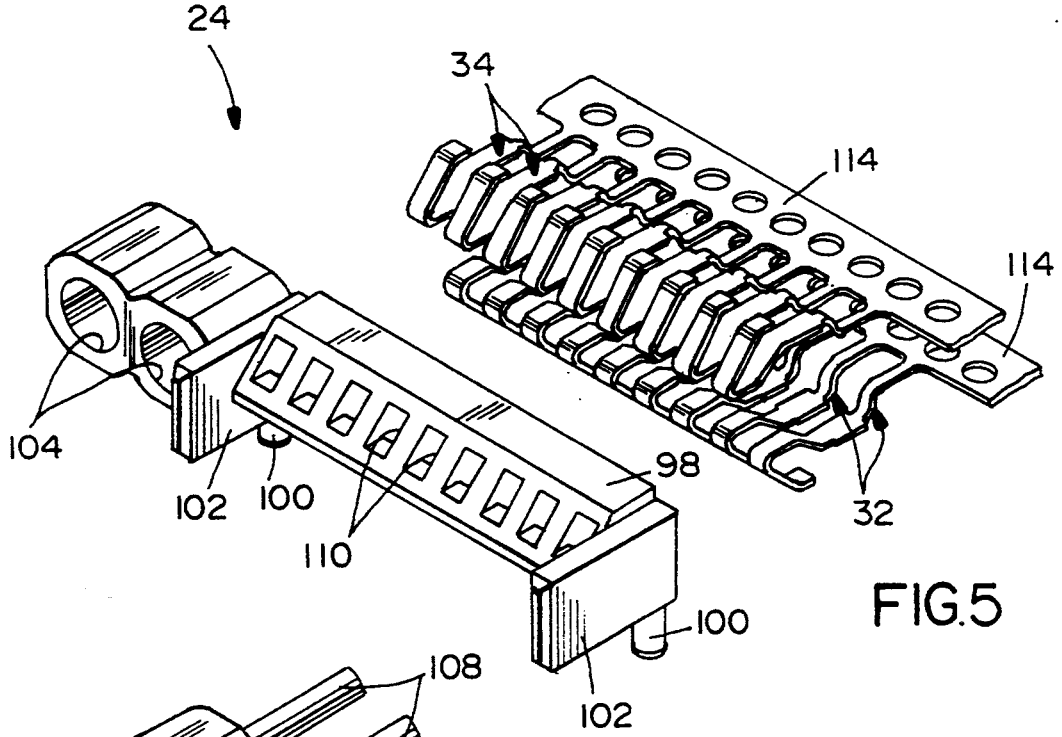
FIG. 5 is an exploded perspective view of the components of the male connector in the base unit of the mobile telephone system.
Figure 6:
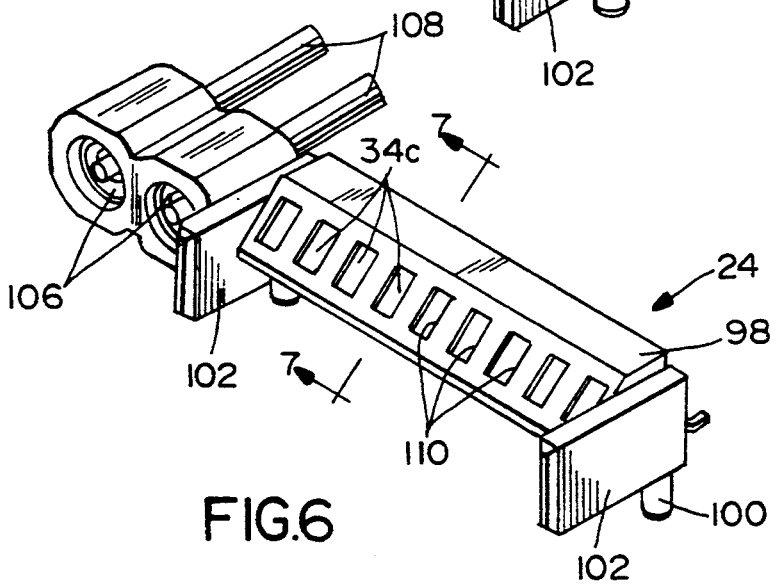
FIG. 6 is a perspective of the male connector in assembled condition.

Referring to FIGS. 5–7 in conjunction with FIG. 1, male connector 12 includes a dielectric housing 98 unitarily molded of plastic material or the like. The housing includes depending mounting pegs 100 for insertion into appropriate mounting holes in printed circuit board 36 (FIG. 1). Male connector housing 98 includes a pair of flanges 102 for insertion into the ends of longitudinal opening 40 in female connector housing 38. The male connector housing further includes a pair of sockets 104 at one end thereof for receiving a pair of coaxial connectors 106 (FIG. 6) which are terminated to a pair of coaxial cables 108, the connectors being mateable with coaxial connectors 58 (FIG. 3) mounted within female connector 24. Lastly, male connector housing 98 has pairs of cavities 110 within which terminals 32 and 34 are mounted in pairs longitudinally of the connector. The housing has a generally V-shaped mating end 112 as best seen in FIG. 7.

Referring to FIGS. 5 and 7, terminals 32 and 34 of male connector 24 are stamped and formed from sheet metal material and are shown in FIG. 5 still connected to carrier strips 114 which are used during the manufacture of the terminals. The carrier strips also are used for "gang" mounting or assembly of the terminals within cavities 110 of male connector housing 98. The terminals have spring arm portions **32*a* and 34*a* extending into cavities 110. It can be seen in FIG. 5 that the spring arm portions are enlarged for press-fitting into the cavities. The terminals also include solder tail portions 32*b* and 34*b* for soldering to circuit traces on printed circuit board 36 (FIG. 1). Lastly, terminals 32 and 34 include spring arm portions 32*c* and 34*c*, respectively, which are formed by U-shaped ends of the terminals bent outwardly and back along spring arm portions 32*a* and 34*a*. It should be noted in FIG. 7 that the spring contact portions 32*c* and 34*c* combine to define a contacting area of a generally V-shaped configuration, as indicated by double-headed arrow "D". It also can be seen that the outer surfaces of the spring contact portions, in the unmated condition shown in FIG. 7, are flush with mating end 112 of male connector housing 8. In other words, the included angle of the spring contact portions, as represented by double-headed arrow "D", is the same as the angle defined by V-shaped mating end 112**.

Figure 9:
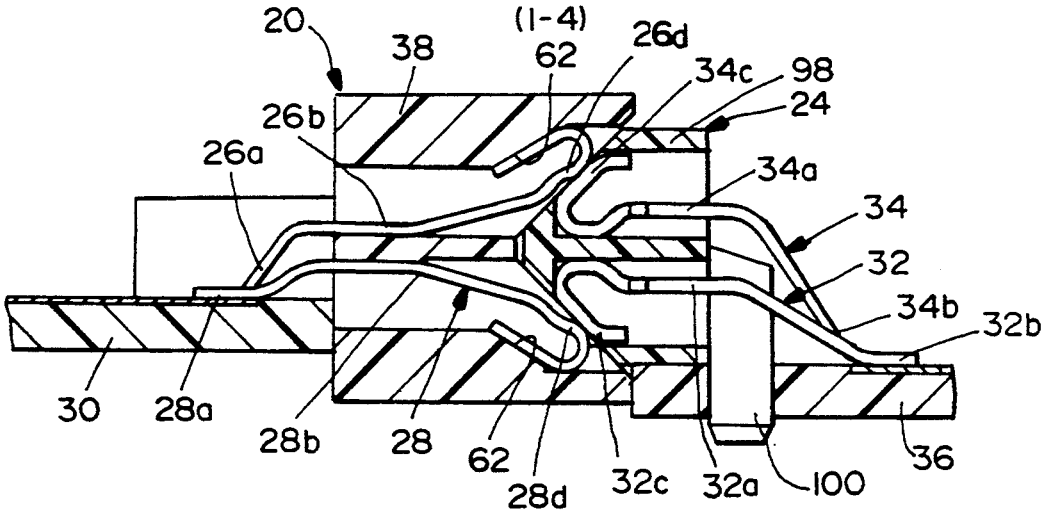
FIG. 9 is a sectional view similar to that of FIG. 8, with the male and female connectors fully mated.
Figure 8:
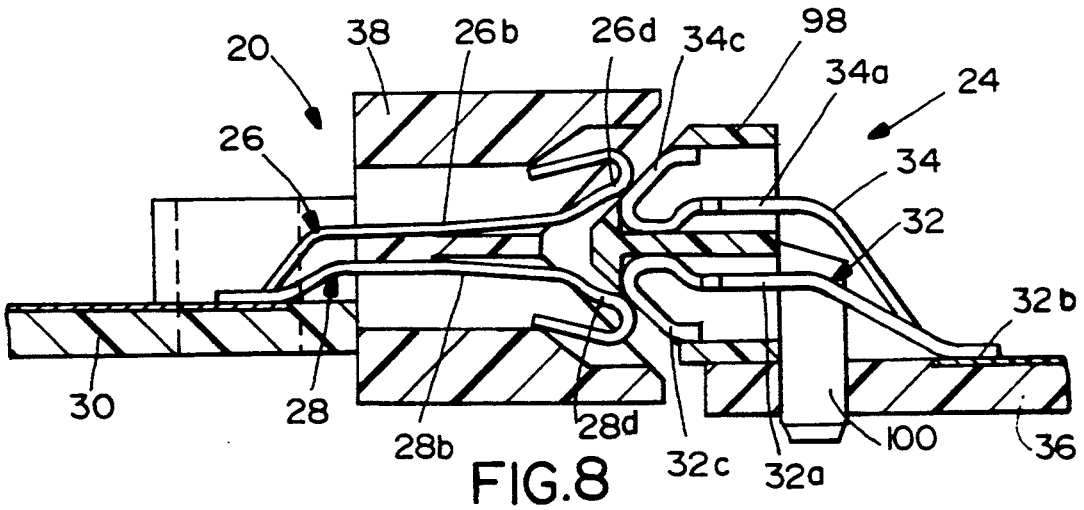
FIG. 8 is a section through the male and female connectors in an initial stage of mating.

Referring to FIGS. 8 and 9, FIG. 8 shows male and female connectors 24 and 20, respectively, in an initial state of mating wherein spring contact portions **26*d* and 28*d* of the terminals of female connector 20 have made initial engagement with spring contact portions 34*c* and 32*c* of the terminals of male connector 24, yet the connectors are not as yet engaged or fully mated. When the connectors are moved together from the initial stage shown in FIG. 8, wherein the respective spring contact portions of the connectors already have engaged, to the fully mated condition shown in FIG. 9, it can be seen that two things have taken place. First, the respective spring contact portions of the connectors have effected a considerable wiping action during mating. Second, it can be seen that spring contact portions 26*d* and 28*d* of the terminals of female connector 20 have been spread apart from the condition of initial engagement with the spring contact portions of the terminals of the male connector as shown in FIG. 8. In fact, it can be seen in FIG. 9 that the U-shaped ends of terminals 26 and 28 of the female connector have been compressed against interior walls 62 of female connector housing 38**. This spreading action of the female connector terminals is effective to store energy in the terminals upon mating of the connectors. This energy then is utilized or is effective to assist in unmating of the connectors, i.e. in reducing the withdrawal forces between the connectors.

In essence, comparing FIGS. 4, 7 and 9, it can be seen that the V-shaped configuration of mating end 112 of the male connector, along with the inclusive angle or V-configuration of spring contact portions **32*c* and 34*c* is the same as the V-shaped configuration of mouth 66 of the female connector as represented by double-headed arrow "B" in FIG. 4. In other words, the angle represented by double-headed arrow "B" in FIG. 4 is the same as the angle represented by double-headed arrow "D" in FIG. 7. However, it can be seen particularly in FIGS. 4 and 8 that the V-configuration or included angle defined by spring contact portions 26*d* and 28*d* of the female connector, as represented by double-headed arrow "C" in FIG. 4, is less than the angle of the V-configuration of the contact area of the male terminal. This difference in angles between the contact areas of the connectors, along with the resiliency in the terminals of at least one of the connectors, is effective to cause the wiping action between the spring contact portions of the terminals, along with the storing of energy in the terminals of at least one of the connectors. Although, in the illustrated embodiment, spring arm portions 26*b* and 28*b*** of the female terminals are more flexible or resilient than those of the male connector terminals (simply due to their longer length), the invention contemplates that the terminals of both connectors could flex instead of just the terminals of one connector, as shown, and still store energy in the terminal array due to the differential between the V-configured contacting areas of the respective connectors. Lastly, it can be understood that by providing V-configured contacting areas, the connectors do not have to be mated in a precise linear mating direction, as has been a problem with pin and socket or blade and socket contact configurations of the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector system which includes first and second electrical connectors mateable in a given general direction, each connector including a housing having a mating end and at least a pair of terminals mounted on the respective housing, the pair of terminals of each connector having spring contact portions engageable with the spring contact portions of the pair of terminals of the other connector, wherein the improvement comprises terminals of the first connector having spring arm portions defining the spring contact portions being configured to diverge at angles to said mating direction toward the mating end of the first connector in a generally V-shaped configuration, each first connector terminal further having a generally U-shaped end extending from said spring contact portion, said U-shaped end bent outwardly of the respective spring arm portion ending in a generally planar leg directed generally opposite said mating direction, said U-shaped end adapted so that, during the mating of the connectors, a surface of said planar leg engages a respective surface of wall means in said first connector housing, said wall surface configured to diverge at an angle to said mating direction toward the mating end of the first connector, after the planar leg bends the U-shaped ends storing energy therein upon mating of the connectors, whereby further mating of the connectors will compress the U-shaded ends further storing energy therein, and the spring contact portions of the terminals of second connector being configured to converge at angles to said mating direction toward the mating end of the second connector in a generally V-configuration.

2. In an electrical connector system as set forth in claim 1, wherein the spring contact portions of the first connector diverge at angles to said mating direction which are less than the angles at which the spring contact portions of the second connector converge relative to the mating direction, whereby the spring contact portions of the respective connectors have a wiping engagement during mating of the connectors and the spring contact portions are effective to store energy upon mating of the connectors which energy is effective to assist in unmating of the connectors.

3. In an electrical connector system which includes first and second electrical connectors mateable in a given general direction, each connector including a housing having a mating end and at least a pair of terminals mounted on the respective housing, the pair of terminals of each connector having spring contact portions engageable with the spring contact portions of the pair of terminals of the other connector, wherein the improvement comprises terminals of the first connector having spring arm portions with generally U-shaped ends bent outwardly of the respective spring arm portions defining the spring contact portions, said spring contact portions being configured to diverge at angle to said mating direction toward the mating end of the first connector in a generally V-shaped configuration, and the spring contact portions of the terminals of the second connector being configured to converge at angles to said mating direction toward the mating end of the second connector in a generally V-configuration, wherein the spring arm portions of the terminals of the first connector are configured to be more flexible than the spring arm portions of the terminals of the second connector.

4. In an electrical connector system as set forth in claim 3, wherein the housing of the first connector includes wall means for engaging the U-shaped ends of the terminals thereof for compressing the U-shaped ends and further storing energy therein upon mating of the connectors.

5. In an electrical connector system as set forth in claim 3, wherein the spring contact portions of the first connector diverge at angles to said mating direction which are less than the angles at which the spring contact portions of the second connector converge relative to the mating direction, whereby the spring contact portions of the respective connectors have a wiping engagement during mating of the connectors and the spring contact portions are effective to store energy upon mating of the connectors which energy is effective to assist in unmating of the connectors.

* * * * *